US006506132B1

(12) United States Patent
Brine, III et al.

(10) Patent No.: US 6,506,132 B1
(45) Date of Patent: Jan. 14, 2003

(54) LACROSSE HEAD POCKET

(75) Inventors: William H. Brine, III, Hopkinton, MA (US); William H. Brine, Hanover, NH (US); Erik Brine, Upton, MA (US)

(73) Assignee: Brine, Inc., Milford, MA (US)

( * ) Notice: Subject to any disclaimer, the term of this patent is extended or adjusted under 35 U.S.C. 154(b) by 0 days.

(21) Appl. No.: 09/843,454

(22) Filed: Apr. 26, 2001

(51) Int. Cl.[7] ..... A63B 59/02; A63B 65/12
(52) U.S. Cl. ..... 473/513; 473/528
(58) Field of Search ..... 473/513, 511, 473/528, 541, 457

(56) References Cited

U.S. PATENT DOCUMENTS 1,866,158 A * 7/1932 Goodwin ..... 473/513
2,142,527 A * 1/1939 Pool ..... 473/513
3,734,499 A * 5/1973 Goldstein ..... 473/528
4,138,111 A * 2/1979 Rule ..... 473/513
5,174,580 A 12/1992 Pratt
5,224,703 A * 7/1993 Osher ..... 473/513
5,269,532 A 12/1993 Tucker et al.

* cited by examiner

*Primary Examiner*—Paul T. Sewell
*Assistant Examiner*—M. Chambers
(74) *Attorney, Agent, or Firm*—Mirick, O'Connell, DeMallie & Lougee, LLP

(57) ABSTRACT

A lacrosse head pocket for a lacrosse head having a scoop and opposing sidewalls. The pocket includes a pocket member comprising one or more thin, flexible portions. The pocket member is connected to the scoop and at least a portion of the sidewalls.

24 Claims, 4 Drawing Sheets

LACROSSE HEAD POCKET

FIELD OF THE INVENTION

This invention relates to a pocket for a lacrosse head.

BACKGROUND OF THE INVENTION

Lacrosse heads comprise basically two portions. An injection molded plastic head frame typically having a generally "V" shape, and netting which is strung from the bottom of the frame to comprise the pocket into which the ball is received and from which the ball is thrown. Typically, the frame defines a series of holes close to its bottom edge along its entire periphery, and a string passed through those holes is used to connect the pocket to the head frame.

The pocket can generally be divided into two sections having generally different functions. When a ball is being carried in the stick, it generally resides in what is termed herein a "ball-carrying pocket portion" that is generally closer to the ball stop or throat portion of the frame as opposed to the scoop portion of the frame. The second portion of the pocket is termed the "shooting portion" herein, and is generally the area of the stringing from which the ball is launched when it is thrown in the usual manner. Typically, when a lacrosse ball is thrown, it moves along the stringing up from the ball-carrying pocket portion towards the scoop and over the shooting portion, and is launched from the head off the scoop, or off the shooting portion stringing close to the scoop. The lower boundary of this portion from which the ball is launched is generally defined in a mesh or strung pocket by additional stringing or lacing in the lacrosse head, typically accomplished by passing shoelaces through the netting along a straight or curved line.

Since the netting is strung to the head frame manually, and since the shooting strings are added manually, there is quite of bit of manual labor involved in stringing a lacrosse head. This adds to the cost of heads, and also adds a human variability factor which results in inconsistent production from person to person, or even from day to day. In addition, the number of separate components making up a traditional pocket is in the range of 8–12, which increases the complexity and costs associated with inventory.

SUMMARY OF THE INVENTION

It is therefore a primary object of this invention to provide a lacrosse head pocket that is extremely consistent from stick to stick.

It is a further object of this invention to provide such a pocket that is less expensive to create and attach to the head frame.

It is a further object of this invention to provide such a pocket that decreases production time substantially, likely by about fifty (50%) percent.

It is a further object of this invention to provide such a pocket that reduces the number of components in a pocket, in the preferred embodiment to five or less.

It is a further object of this invention to provide such a pocket that allows for different looks and color schemes.

It is a further object of this invention to provide such a pocket that is more durable and easier to use.

It is a further object of this invention to provide such a pocket that provides a consistent release of the ball without the need for any maintenance tuning.

It is a further object of this invention to provide such a pocket that provides a very smooth ball release from the head.

It is a further object of this invention to provide such a pocket that virtually eliminates the occurrence of unwanted "whip" in throwing the ball.

It is a further object of this invention to provide such a pocket that is customizable and thus can be designed to be tailored to players of all different playing styles.

This invention results from the realization that lacrosse head pockets can be made more uniform, more consistent, and less expensively by replacing all or a portion of the pocket with a molded plastic member or members that attach to the head frame.

This invention may be accomplished in a lacrosse head pocket, the lacrosse head having a scoop and opposing sidewalls, the pocket comprising a pocket member comprising one or more thin flexible portions; means for connecting the pocket member to the scoop; and means for connecting the pocket member to the sidewalls.

The lacrosse head pocket may further comprise means for connecting pocket stringing to the pocket member. The pocket member may comprise a plastic sheet or molded part defining a number of openings through the faces to decrease wind resistance. The pocket member may have a partial outline shape that conforms generally to the inside of the scoop and the sidewalls proximate the scoop. In that case, the pocket member may span between the sidewalls, and have an outline shape between the sidewalls defining a curve such that the length of the pocket member proximate the sidewalls is greater than its length along its center.

The means for connecting pocket stringing to the pocket member may comprise a series of openings along the interior periphery of the pocket member. The pocket member may have an inner surface defining a series of small projections.

The scoop may define one or more stringing holes, and the means for connecting the pocket member to the scoop may comprise means for connecting the pocket member to one or more of the stringing holes. In that case, the means for connecting the pocket member to one or more of the stringing holes may comprise connector members along at least a part of the periphery of the pocket member. The connector members may comprise integral tabs projecting from the periphery of the thin, flexible members or sheet. At least some of the tabs may define an enlarged "mushroom" head, and be adapted to pass through a stringing hole.

The sidewalls may each define one or more stringing holes, and the means for connecting the pocket member to the sidewalls may comprise means for connecting the pocket member to one or more of the stringing holes. The means for connecting the pocket member to one or more of the stringing holes may comprise connector members along at least a part of the periphery of the pocket member. The connector members may comprise enlarged-head pins or knobs, or integral tabs projecting from the periphery of the thin, flexible sheet. At least some of these tabs may be adapted to pass through a stringing hole.

The lacrosse head pocket may further comprise a ball-carrying pocket portion. The lacrosse head pocket may further comprise means for connecting the ball-carrying pocket portion to the sidewalls. The sidewalls may each define one or more stringing holes, and the means for connecting the ball-carrying pocket portion to the sidewalls may comprise means for connecting the ball-carrying pocket portion to one or more of the stringing holes. The means for connecting the ball-carrying pocket portion to one or more of the stringing holes may comprise connector members along at least a part of the periphery of the ball-carrying pocket portion. The connector members may comprise integral tabs projecting from the periphery of the ball-carrying pocket portion. At least some of the tabs may define an enlarged head and be adapted to pass through a stringing hole. The ball-carrying pocket portion may comprise a flexible plastic member defining a plurality of openings therein.

The ball-carrying pocket portion may be integral with the pocket member. The ball-carrying pocket portion or the pocket member may be integral with the lacrosse head. For example, the ball-carrying pocket portion may be snapped to, adhered to or molded to the pocket member and the head by inserting a woven or molded mesh piece into an injection mold and molding a flexible and durable material such as TPE (Thermoplastic Elastomer) around the end the end, so as to create the pocket member, with the pieces fused together. The ball-carrying pocket portion may be integral with the lacrosse head.

BRIEF DESCRIPTION OF THE DRAWINGS

Other objects, features and advantages will occur to those skilled in the art from the following description of the preferred embodiments and the accompanying drawings in which.

DETAILED DESCRIPTION OF THE PREFERRED EMBODIMENTS

The invention features a lacrosse head pocket comprising a pocket member which itself comprises one or more thin, flexible portions or members such as sheets, and means for connecting the pocket member to the scoop, and means for connecting the pocket member to the sidewalls. The inventive pocket member may comprise some or all of the pocket for the lacrosse head. Two preferred embodiments are shown. In one embodiment, the pocket member replaces what would traditionally be considered the shooting portion of the traditional stringing (from the shooting strings up to the scoop). In another embodiment, the lacrosse head pocket of the invention replaces the entirety of the stringing, or just the ball-carrying pocket portion. Preferably, the pocket member is a molded plastic sheet which carries enlarged-head tabs, snaps or other means for connecting it to the head using the stringing holes found around the entire periphery of the head frame in a typical lacrosse head. In another alternative embodiment, the inventive pocket is integrally molded with the head frame. Other means of attaching the pocket to the head frame are also contemplated.

Figure 1:
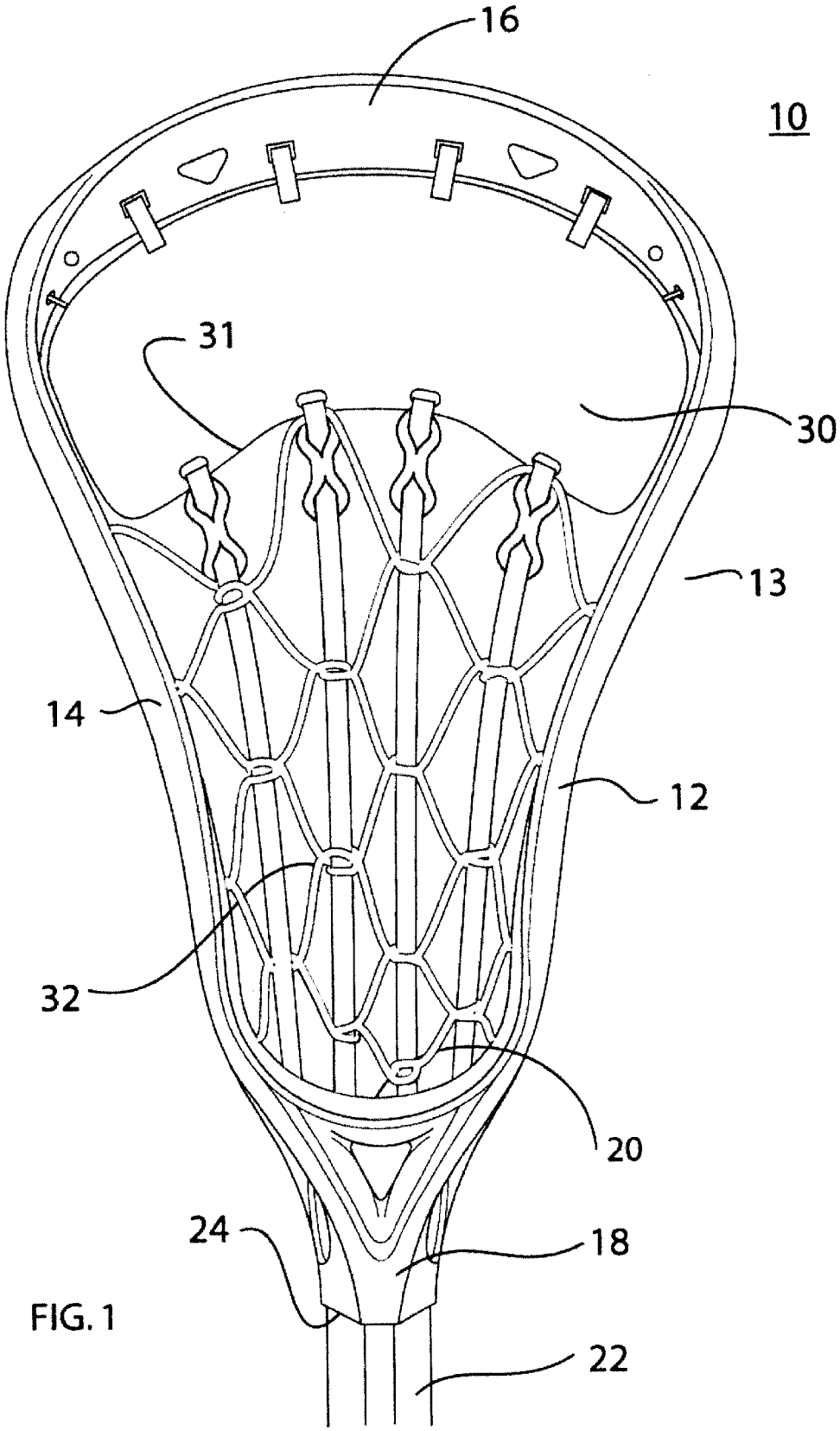
FIG. 1 is a front elevational view of a lacrosse stick showing one simple embodiment of the invention.

FIG. 1 depicts lacrosse stick 10 comprising shaft 22 which fits into socket 24 of traditional molded plastic head frame 12. Head frame 12 carries pocket 13 comprising pocket member 30 and traditional stringing 32. Pocket member 30 in this embodiment comprises a thin, flexible thermoplastic sheet. The sheet would typically have openings, not shown in FIG. 1, to decrease the wind resistance and also to create a more traditional appearance.

Pocket member 30 has a partial outline shape that conforms generally to the inside of head frame scoop 16 and the portions of sidewalls 12 and 14 proximate scoop 16. In this embodiment, pocket member 30 spans the distance between sidewalls 12 and 14. Pocket member 30 has an outline shape 31 between the sidewalls that defines a curve such that the length of the pocket member 30 proximate the sidewalls is greater than its length along its center (in other words, the portion that is aligned with the axis of shaft 22 spanning from the center of curve 31 to the center of scoop 16).

Figure 2:
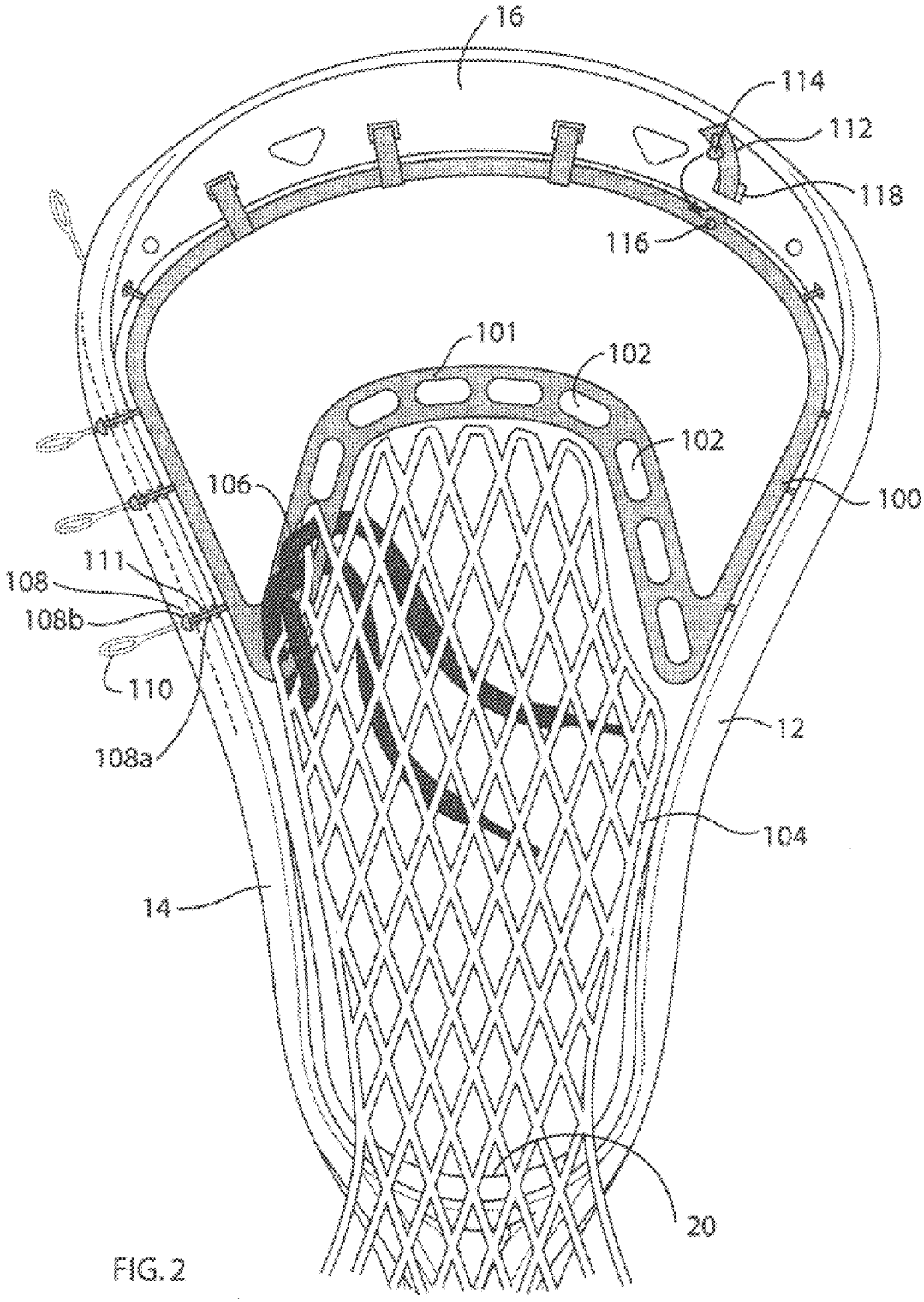
FIG. 2 is a more detailed front elevational view of a lacrosse head with a lacrosse head pocket of this invention partially shown and shown being installed onto a head.

FIG. 2 partially depicts pocket member 100 partially attached to, and partially in the process of being attached to, scoop 16 and sidewalls 12 and 14. In this example, the general inverted "U" or "V" shape of outline shape 101 spanning between the sidewalls mimics the path of typical shooting strings in a prior art strung lacrosse head. This shape is not a limitation of the invention, as this spanning outline could go straight across the head or down, or take other shapes to accomplish a look or function as desired. Functionally, this outline shape defines the end of a channel in netting 104 that leads generally up from the ball stop area 20 towards scoop 16. Pocket member 100 thus acts as a ball launch guide and launch ramp when the ball is thrown from the lacrosse head.

Member 100 comprises a plastic sheet made of a material and having a thickness to accomplish a desired function. The durometer of the material can be selected to accomplish a desired stiffness. The material and its thickness can be selected to contribute to the stiffness and also achieve a desired feel and durability. In one embodiment, the pocket member of this invention is made from Surlyn™ (from Dupont) or Pellethane™ (Dow Chemical).

Pocket member 100 is connected to scoop 16 and connected in this case to the upper portion of sidewalls 12 and 14. This connection can be accomplished in any desired manner. In an embodiment described below, the pocket member is integrally molded with the lacrosse head so the connection is permanent. In the embodiment shown in FIG. 2, pocket member 100 carries tabs or other structures that allow it to be connected to scoop 16 and sidewalls 12 and 14 through openings such as 111 and 118 that are already in the sidewalls and scoop to accommodate the traditional stringing. In this example, pocket member 100 is connected to sidewalls 12 and 14 by members 108 that have an extending axial portion 108*a* and a terminal enlarged "mushroom" head 108*b*. Member 108 can be pulled through opening 111 from the inside by attaching string or pull member 110 to member 108 in such a manner that member 110 can be cut off or removed from member 108 when the assembly is complete. Member 110 is pulled through opening 111 from the inside, to the outside position shown in FIG. 2, thereby forcing enlarged portion 108*b* through opening 111. Since member 108 is made from a flexible plastic material, when portion 108*b* emerges from opening 111 it unfolds to its original button-shape overlaying the intersection of opening 111 with the outer portion of sidewall 14, to inhibit member 108 from being pulled back through opening 111 from the force of game play.

FIG. 2 also discloses one of myriad possibilities of removably connecting pocket member 110 to scoop 116 (or to the sidewalls, for that matter). Connector member 112 along the upper periphery of pocket member 100 is designed to pass through stringing hole 118 and close back on itself, or be attached back to pocket member 100. In this example, button 114 is designed to fit into or through opening 116 to accomplish this interconnection. Alternatives for such interconnection include insert molding for an integral, permanent connection, or include snaps, buttons, adhesives or other closures or interconnection means that either permanently or removably connect the pocket member to the head frame.

Pocket member 100 comprises only a portion of the "netting" required to close the lacrosse head so that a lacrosse ball can be caught, carried and thrown. The other part of the opening is closed by traditional mesh netting 104 (or traditional stringing) that is attached to the remainder of the sidewalls 12 and 14 and ball stop 20 in a traditional manner, not shown in this drawing. There must also be some means for connecting pocket stringing 104 to pocket member 110. In this case, such is accomplished by interweaving lace 106 through the upper portion of pocket stringing 104 and openings 102 in the lower spanning portion 101 of pocket member 100. Any other interconnection means, including the types described above, can also be used.

Figure 3:
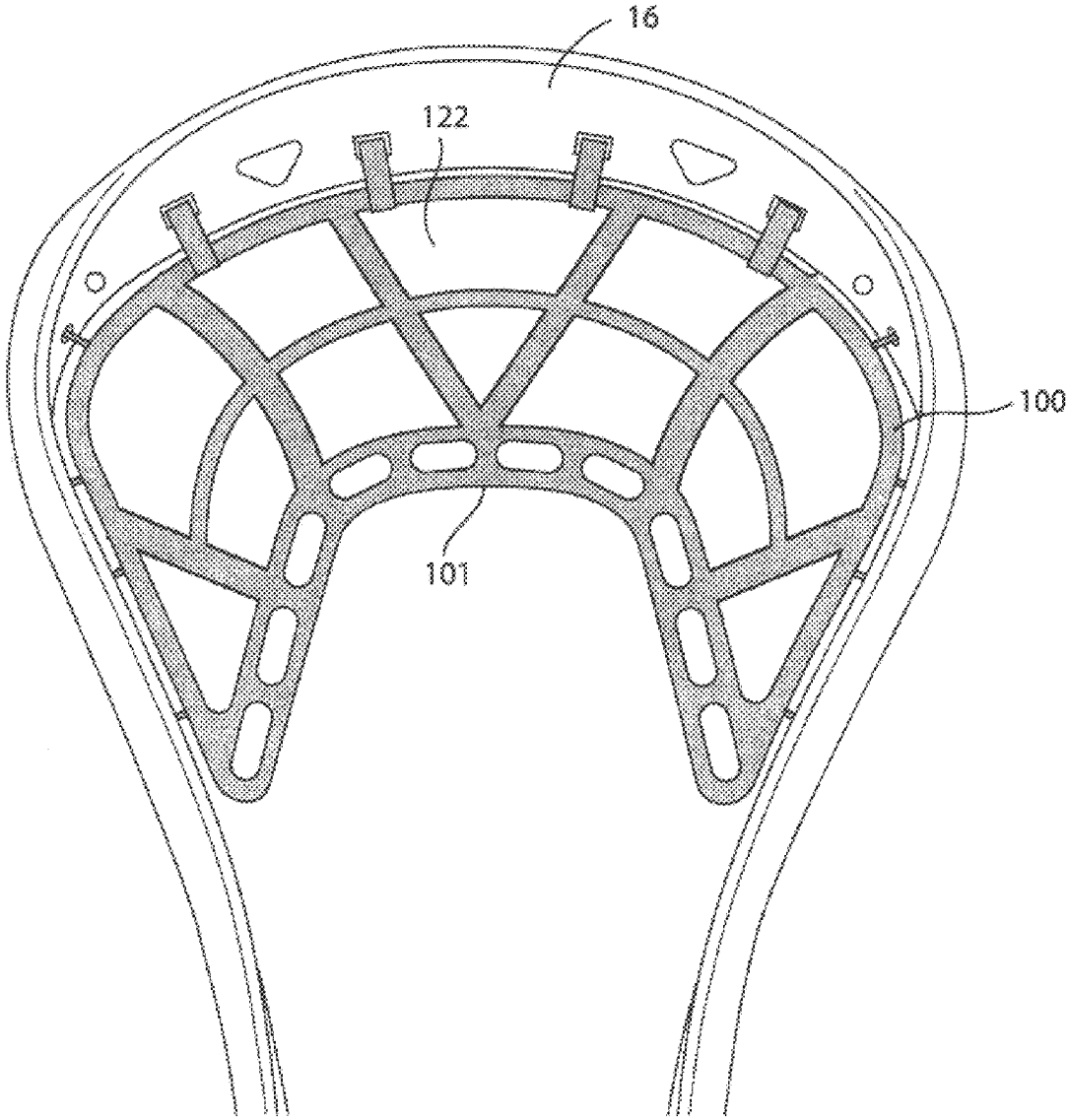
FIG. 3 shows the entirety of one embodiment of the partial lacrosse head pocket shown in FIG. 2.

One preferred embodiment of a complete pocket member 100 is shown in FIG. 3. Central portion 122 (not shown in FIG. 2 for clarity purposes only) can take any desired configuration as long as it is able to catch and hold a lacrosse ball. Shown is one of innumerable possibilities of thin strips that define openings that are present to decrease wind resistance. Since member 100 is an integral plastic member, the openings through the member can be formed in the molding process, or die cut into a plastic sheet.

Pocket member 100 thus provides all of the advantages described above. These include ease of assembly and consistency in the ball launch region of the lacrosse head. The consistency is accomplished because the pocket member of this invention is made from one or more thin, flexible sheets that can be made in a uniform production process such as by injection molding or extrusion and die cutting. There is thus no dependence on a person stringing this portion of the head to accomplish the uniformity. Additionally, the functionality can be customized by choice of materials, thicknesses, construction, and features of the pocket member.

Figure 4:
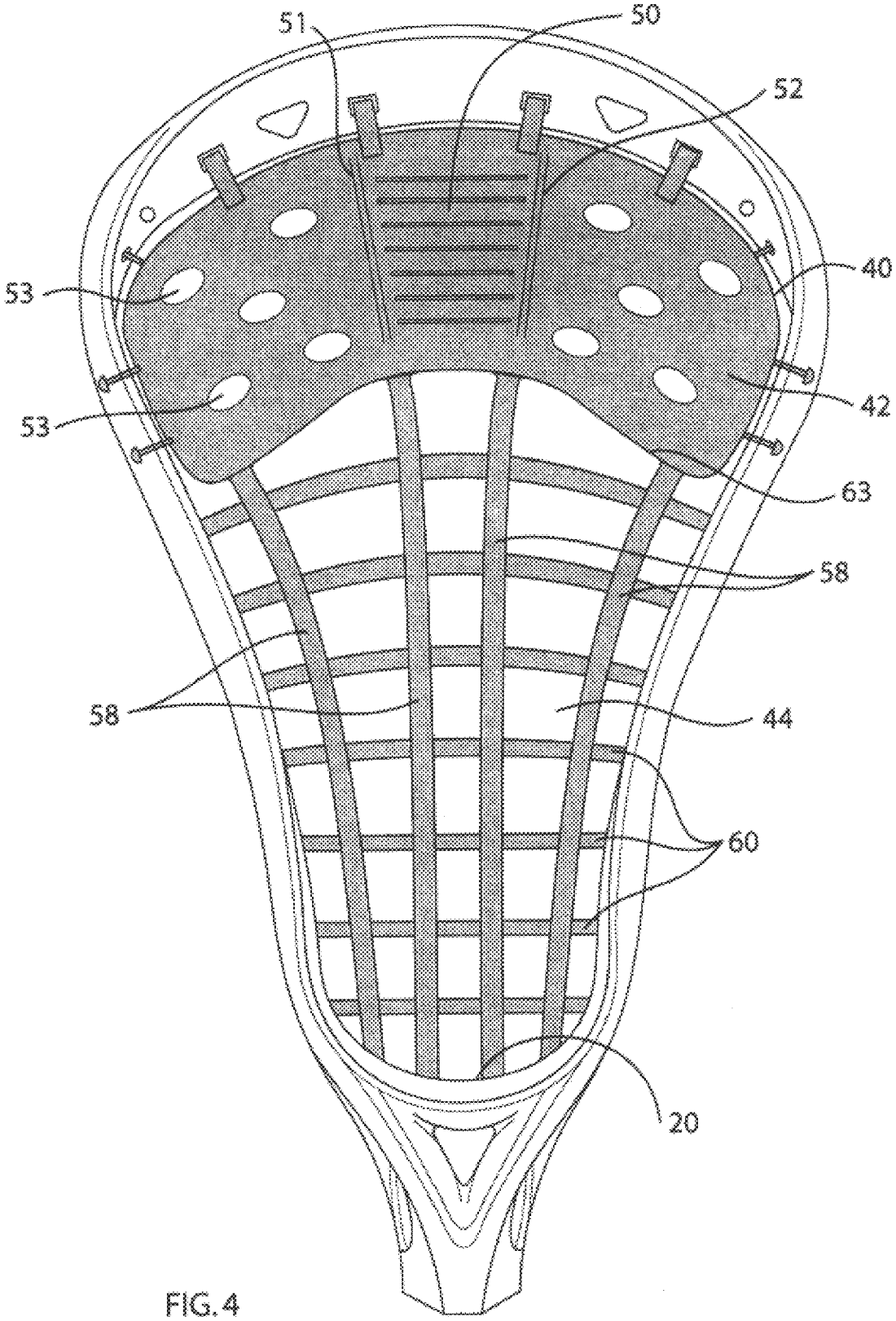
FIG. 4 is an elevational view of an alternative embodiment of a full lacrosse head pocket according to this invention.

Another embodiment of the invention is shown partially in FIG. 4. FIG. 4 depicts pocket 40 that comprises a replacement for the entirety of the stringing in a traditional lacrosse head. In other words, pocket 40 entirely closes the open area of a lacrosse head. Pocket 40 thus has an outline shape that generally conforms to the inner perimeter of a lacrosse head that it is to be used on. Pocket 40 can be produced separately and connected to a lacrosse head, or integrally molded in the lacrosse head forming process itself. Pocket 40 also illustrates other aspects of the invention. Pocket member 42 is separated by boundary 63 from ball-carrying pocket portion 44 that comprises intersecting integral plastic strips 58 and 60. Pocket member 42 defines ball launch guide area 50 defined by perimeter raised lines 51 and 52. This helps to channel the ball properly from the center of the head when it is thrown so that the throw is more accurate and whip and other throwing problems are reduced or eliminated. It should be understood that there is no requirement that area 50 be so defined in the pocket member, but such is possible since these designs can be accomplished by creating the appropriate molding tool. Openings 53 decrease wind resistance. Molded protrusions 50 create tactile feedback to the player as the ball rolls over them.

Pocket 40 thus defines both pocket member 42 (which defines the shooting portion) and ball-carrying pocket portion 44. Both pocket member 42 and pocket portion 44 are connected to the lacrosse head frame in any of the manners described above. Pocket portion 44 is connected to the lower portions of the sidewalls and to ball stop area 20.

Although specific features of the invention are shown in some drawings and not others, this is for convenience only as some feature may be combined with any or all of the other features in accordance with the invention.

Other embodiments will occur to those skilled in the art and are within the following claims:

What is claimed is:

1. A lacrosse head pocket, the lacrosse head having a scoop and opposing sidewalls, the pocket closing the head such that a lacrosse ball entering the head is retained by the pocket, comprising:

a pocket member defining only a portion of the pocket and comprising one or more thin flexible portions;

means for directly connecting the pocket member to the scoop;

means for directly connecting the pocket member to the portions of the sidewalls proximate thereof; and a separate ball-carrying pocket portion coupled to the sidewalls and to the pocket member to complete the pocket.

2. The lacrosse head pocket of claim 1, wherein the pocket member comprises a plastic sheet defining a number of openings through the faces to decrease wind resistance.

3. The lacrosse head pocket of claim 1, wherein the pocket member has a partial outline shape that conforms generally to the inside of the scoop and the sidewalls proximate the scoop.

4. The lacrosse head pocket of claim 3, wherein the pocket member spans between the sidewalls, and has a lower outline shape between the sidewalls defining a curve such that the length of the pocket member proximate the sidewalls is greater than its length along its center.

5. The lacrosse head pocket of claim 1, wherein the pocket portion is connected to the pocket member by a means comprising a series of openings along the interior periphery of the pocket member adjacent the pocket portion.

6. The lacrosse head pocket of claim 1, wherein the pocket member has an inner surface defining a series of small projections.

7. The lacrosse head pocket of claim 1, wherein the scoop defines one or more stringing holes, and wherein the means for directly connecting the pocket member to the scoop comprises means for directly connecting the pocket member to one or more of the stringing holes.

8. The lacrosse head pocket of claim 7, wherein the means for directly connecting the pocket member to one or more of the stringing holes comprises connector members along at least a part of the periphery of the pocket member.

9. The lacrosse head pocket of claim 8, wherein the connector members comprise integral tabs projecting from the periphery of the thin, flexible sheet.

10. The lacrosse head pocket of claim 9, wherein at least some of the tabs define an enlarged head, and are adapted to pass through a stringing hole.

11. The lacrosse head pocket of claim 1, wherein the sidewalls each define one or more stringing holes, and wherein the means for directly connecting the pocket member to the sidewalls comprises means for directly connecting the pocket member to one or more of the stringing holes.

12. The lacrosse head pocket of claim 11, wherein the means for directly connecting the pocket member to one or more of the stringing holes comprises connector members along at least a part of the periphery of the pocket member.

13. The lacrosse head pocket of claim 12, wherein the connector members comprise integral tabs projecting from the periphery of the thin, flexible sheet.

14. The lacrosse head pocket of claim 13, wherein at least some of the tabs define an enlarged head, and are adapted to pass through a stringing hole.

15. The lacrosse head pocket of claim 1, further comprising means for directly connecting the ball-carrying pocket portion to the sidewalls.

16. The lacrosse head pocket of claim 15, wherein the sidewalls each define one or more stringing holes, and wherein the means for directly connecting the ball-carrying pocket portion to the sidewalls comprises means for directly connecting the ball-carrying pocket portion to one or more of the stringing holes.

17. The lacrosse head pocket of claim 16, wherein the means for directly connecting the ball-carrying pocket portion to one or more of the stringing holes comprises connector members along at least a part of the periphery of the ball-carrying pocket portion.

18. The lacrosse head pocket of claim 17, wherein the connector members comprise integral tabs projecting from the periphery of the ball-carrying pocket portion.

19. The lacrosse head pocket of claim 18, wherein at least some of the tabs define an enlarged head, and are adapted to pass through a stringing hole.

20. The lacrosse head pocket of claim 1, wherein the ball-carrying pocket portion comprises a flexible plastic member defining a plurality of openings therein.

21. The lacrosse head pocket of claim 20, wherein the ball-carrying pocket portion is integral with the pocket member.

22. The lacrosse head pocket of claim 1, wherein the pocket member is integral with the lacrosse head.

23. The lacrosse head pocket of claim 1, wherein the ball-carrying pocket portion is integral with the lacrosse head.

24. A lacrosse head pocket, the lacrosse head having a scoop and opposing sidewalls, the pocket closing the head such that a lacrosse ball entering the head is retained by the pocket, the pocket comprising:

a pocket member defining only a portion of the pocket, the pocket member comprising a plastic sheet defining a number of openings therein, the pocket member having edges that define a partial outline shape that conforms generally to the inside of the scoop and the sidewalls proximate the scoop, and spanning between the sidewalls to close the upper portion of the head proximate the scoop;

a series of connectors directly connecting the edges of the pocket member proximate the scoop and sidewalls to the scoop and sidewalls, respectively;

a mesh piece comprising the remainder of the pocket, the mesh piece having edges that define an outline shape that conforms generally to the pocket member edge that spans between the sidewalls, and to the remainder of the sidewalls; and means for coupling the mesh piece to the pocket member edge that spans between the sidewalls and to the remainder of the sidewalls, to complete the attachment of the pocket to the head.

* * * * *